US005662229A

United States Patent [19]

Edwards

[11] Patent Number: 5,662,229

[45] Date of Patent: Sep. 2, 1997

[54] MODEL RAILROAD COUPLER CENTERING SYSTEM

[75] Inventor: Lawrence D. Edwards, Eagle Point, Oreg.

[73] Assignee: Kadee Quality Products Co., White City, Oreg.

[21] Appl. No.: 745,564

[22] Filed: Nov. 8, 1996

[51] Int. Cl.[6] ..... A63H 19/18

[52] U.S. Cl. ..... 213/75 TC

[58] Field of Search ..... 213/75 TC, 75 D, 213/77, 110

[56] References Cited

U.S. PATENT DOCUMENTS

| | | | |
|---|---|---|---|
| D. 326,693 | 6/1992 | Gramera . | |
| 2,409,920 | 10/1946 | Wicher . | |
| 2,617,541 | 11/1952 | Goode . | |
| 3,115,255 | 12/1963 | Edwards et al. . | |
| 3,117,676 | 1/1964 | Edwards et al. . | |
| 4,335,820 | 6/1982 | Gramera . | |
| 4,512,483 | 4/1985 | Crossley et al. | 213/75 TC |
| 5,316,158 | 5/1994 | Dunham et al. . | |
| 5,509,546 | 4/1996 | Staat . | |

FOREIGN PATENT DOCUMENTS

| | | | |
|---|---|---|---|
| S121715 | 10/1994 | Australia . | |
| 3821983 | 1/1990 | Germany | 213/75 TC |
| 4020756 | 8/1991 | Germany . | |

*Primary Examiner*—S. Joseph Morano
*Attorney, Agent, or Firm*—Robert D. Varitz

[57] ABSTRACT

A model railroad coupler centering system includes a draft box and a coupler. The coupler includes a coupler head and a coupler knuckle. An elongate coupler shank extends between the coupler head and a coupler mounting structure. The coupler mounting structure includes a mounting plate, which may have forwardly diverging sides thereto. Plural centering springs are fixed on each side of the coupler mounting plate such that when the coupler is centered, the centering springs make touching, non-flexed contact with the interior of the draft box and, when the coupler is pushed off-center, one of the centering springs makes flexed contact within an interior side of the draft box and the other centering spring does not make any contact with the other side of the draft box.

10 Claims, 2 Drawing Sheets

MODEL RAILROAD COUPLER CENTERING SYSTEM

BACKGROUND OF THE INVENTION

This invention relates to model railroad couplers, and specifically to a centering system for such couplers.

Model railroads, as the name suggests, are scale models of prototype railroads. A complete model railroad includes a track layout, a power source, which is usually electric, non-powered rolling stock, and at least one powered engine, or powered rolling stock.

Because model railroads are scale models of prototype railroads, it is important to model railroaders that the rolling stock, whether powered or non-powered, be a precise imitation of a full scale, unit. To this end, the coupling between units of rolling stock is of critical importance.

The National Model Railway Association (NMRA) had adopted what is known as a hook-and-horn coupler as its standard. While this coupler is effective in joining units of model railroad rolling stock, it is not prototypical, in that it does not look like the coupler generally used railroads found in the western hemisphere. The NMRA hook-and-horn coupler is usually manufactured from plastic material, and includes an integrally formed centering spring mechanism. A significant problem arises when a centering spring mechanism is fabricated from any polymer material: the polymer material has a "memory". When a train has been parked on a curved section of track, with the couplers held off-center, for an extended period of time, i.e., several days, the polymer springs tend to deform, and will then be biased to that deformed condition when released. The use of metal springs virtually eliminates the problem of centering spring deformity.

A number of couplers provide prototypical appearance of couplers which are used on prototypical railroads in the western hemisphere. The most prevalent coupler is the Magna-Matic® coupler, manufactures by Kadee Quality Products, Inc., and often referred to as a Kadee® coupler. Kadee® couplers have a very realistic appearance and are also magnetically operable to provide for remote coupling and uncoupling. Kadee® couplers have been manufactured for many years and are the standard which is adopted by most model railroad clubs. One of the features of a Kadee® couplers is that it remains centered, parallel with the longitudinal axis of the rolling stock to which it is mounted, and will return to a center position even if left coupled on a curved section of track for an extended period of time. The reason that the Kadee® coupler returns to its center position is because the centering spring used in Kadee® couplers is metallic. Most Kadee® couplers use a phosphor-bronze centering spring, as depicted in FIG. 1, generally at 10. Phosphor-bronze spring 10 is formed of a single piece of metal, and includes a base portion 12, a rear portion 14, and two spring portions 16, 18, which extend from base portion 12, adjacent the forward edge 12*a* thereof, and which terminate even with rear portion 14. Rear portion 14 acts as a stop for spring portions 16, 18. As might be expected, phosphor-bronze spring 10 is a relatively expensive piece to manufacture, and has been known to cause a certain amount of frustration to users of the Kadee® coupler, in that it is quite small and is difficult to handle.

A number of structures have been developed in an attempt to provide a centering mechanism for a coupler which does not use a spring such as phosphor-bronze spring 10. By in large, these other devices have been formed of polymer material and have had spring components thereof extending outward from a variety of locations. The polymer springs have the problem of centering spring deformation if left on a curved track for any length of time.

Wicher, U.S. Pat. No. 2,409,920 depicts a coupler mechanism which includes a centering spring having a u-shaped contour, which is attached to the shank of a coupler by means of a clip. The clip is held in place by the same fastener which holds the coupler to the rolling stock, requiring a certain amount of manual dexterity in locating the coupler on the rolling stock.

Goode, U.S. Pat. No. 2,617,541 depicts a model railroad coupler having a variety of spring mechanisms, including leaf springs mounted on the coupler and on the draft box therefor, as well as oppositely acting coil springs, which serve to center the coupler. The coupler taught by Goode includes, in some embodiments, a multi piece shank which carry separate pieces of the coupler head thereon. Likewise, Foulkes, Australian Design Patent AU-S-121715 discloses a two piece coupler having overlaid shanks, wherein each portion of the shank carries a spring thereon, which spring coacts with the draft box.

German Patent DE4020756-C discloses a coupler having spring mechanism extending from the base of the shank thereof to provide a centering mechanism. Likewise, Staat, U.S. Pat. No. 5,509,546 and Gramera, U.S. Pat. No. D326, 693 both disclose couplers which have spring mechanisms integrally formed with the shank thereof and which extend outward from the shank to provide a centering mechanism.

Many of the previous described devices are formed of plastic materials which have polymeric memory. Thus, if a train is left in a coupled conditioned and is left on a curved section of track for any length of time, the polymer material will "remember" the deformed condition of the centering springs and, when the cars are uncoupled, will continue to hold the coupler off-center. The couplers will not easily join nor easily uncouple with one-another when it s desired to form another train. This is an undesirable condition and, for this reason, such couplers are not favored by model railroaders.

It is an object of the instant invention to provide a centering mechanism which is integrally formed with the coupler.

Another object of the invention is to provide a centering mechanism which is easy to manufacture and handle.

A further object of the invention is to provide a centering mechanism which will return the coupler to a centered position, regardless of how long the coupler has been held off-center.

Yet another object of the invention is to provide a centering mechanism which maintains the coupler in a centered condition while the coupler mechanism itself is in a relaxed condition.

SUMMARY OF THE INVENTION

The model railroad coupler centering system of the invention includes a draft box and a coupler. The coupler includes a coupler head and a coupler knuckle. An elongate coupler shank extends between the coupler head and a coupler mounting structure. The coupler mounting structure includes a mounting plate which may have forwardly diverging sides thereto. Plural centering springs are fixed on each side of the coupler mounting plate such that when the coupler is centered, the centering springs make touching, non-flexed contact with the interior of the draft box and, when the coupler is pushed off-center, one of the centering springs makes flexed contact within an interior side of the draft box and the other centering spring does not make any contact with the other side of the draft box.

These and other objects and advantages of the invention will become more fully apparent as the description which follows is read in conjunction with the drawings.

DETAILED DESCRIPTIONS OF THE PREFERRED EMBODIMENT

Figure 1:
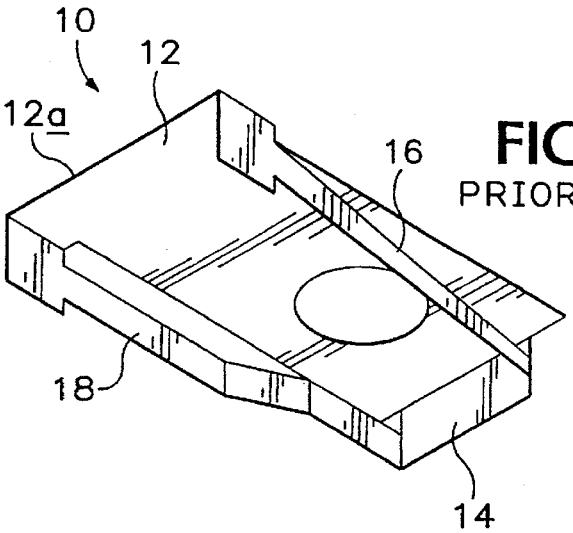
FIG.1 PRIOR ART
FIG. 1 depicts a prior art phosphor-bronze centering spring.
Figure 2:
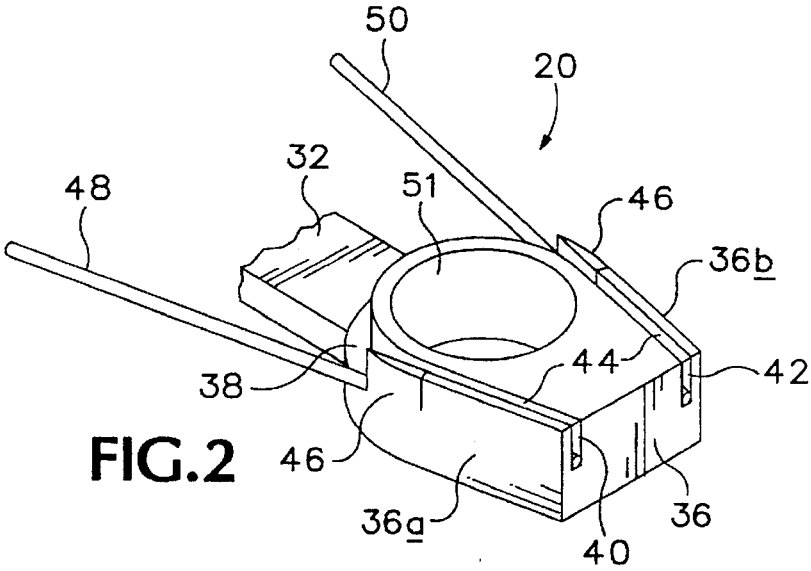
FIG. 2 depicts a mounting structure for the coupler of the invention, in a first stage of manufacture.
Figure 4:
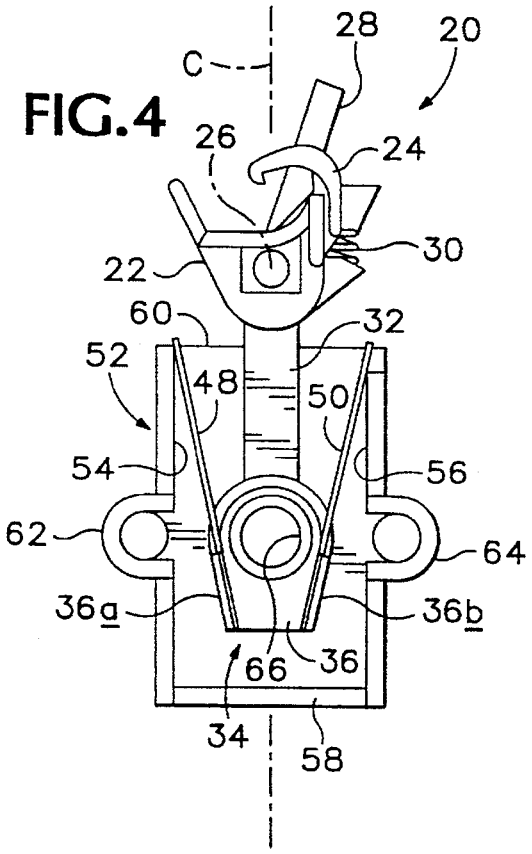
FIG. 4 depicts the coupler of the invention located in a centered condition in a draft box.

Returning now to the drawings, and initially to FIGS. 2 and 4, the coupler of the invention is depicted generally at 20. Coupler 20 includes a coupler head 22, having a coupler knuckle 24 pivotally attached thereto. Knuckle 24 pivots about a pivot point 26, which extends through one end of a curved "air hose" 28, which is formed of a magnetic metal and which pivots within coupler head 22, carrying knuckle 24 thereon. Knuckle 24 is biased to a closed position, depicted in FIGS. 4–6, by knuckle spring 30. Coupler head 22 is carried on one end of coupler shank 32 while coupler mounting structure 34 is carried on the other end of shank 32.

Figure 3:
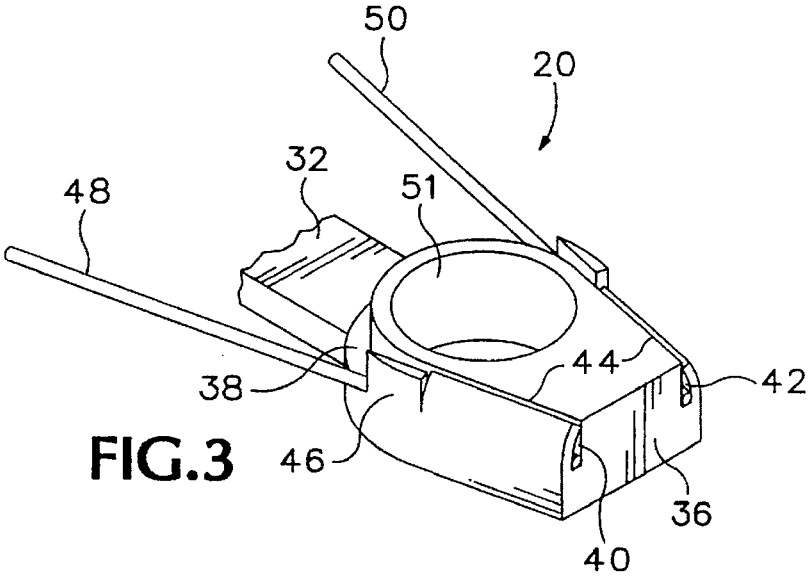
FIG. 3 depicts a second stage of manufacture of the coupler of FIG. 2.

Mounting structure 34 includes a mounting plate 36 which has what are referred to herein as forwardly diverging sides **36*a*, 36*b*. Mounting structure 34 also includes a stepped area 38 which extends across the forward region of mounting structure 34, adjacent shank 32. As depicted in FIG. 2, slots 40, 42 are formed along sides 36*a* and 36*b* of mounting structure 34. Slots 40, 42, also referred to herein as centering spring receivers, are formed with a first tab 44 and a second tab 46 along the outer margin thereof. The base of slots 40, 42 is a continuation of stepped region 38, which may be seen to extend about a majority of the periphery of mounting structure 34. Centering springs 48, 50 are inserted into slots 40, 42, respectively, and the first tabs 44 are compressed, as depicted in FIG. 3, to capture centering springs 48, 50 within slots 40, 42, respectively. Springs 48, 50** are formed of small diameter wire; 0.002 and 0.15 inches.

Coupler 20 is manufactured in several pieces: mounting structure 36, shank 32 and coupler head 22 are molded together. Coupler knuckle 24 is separately molded and joined to coupler head 22 by air hose 28. Knuckle spring 30 is then inserted between receivers on coupler head 22 and coupler knuckle 24. Stepped region 38 maybe formed during the molding of the coupler, or may be machined in a separate step. Stepped region 38 provides a base for the centering spring, and allows the spring to flex towards shank 32 without obstruction or distortion.

Turning now to FIG. 4, coupler 20 is depicted mounted in a draft, or coupler, box 52. Draft box 52, in the preferred embodiment, has parallel sides 54, 56, a rear end 58 and an open forward end 60. Draft box 52 may be secured to the rolling stock by means of fasteners which extend through flanges 62, 64, or by a single fastener which extends through a post 66. Coupler mounting structure 34 includes a bore 51 therethrough, which is clearance fittable over post 66. Post 66 is also referred to herein as a coupler receiving structure.

It will be appreciated by those of skill in the art that many model railroad rolling stock units are manufactured with a built in draft box of some form. Such draft boxes may be a simple structure, which is formed with the rolling stock undercarriage and which includes a received for a threaded fastener, which fastener may also serve the function of post 66. Other draft box embodiments may include an upper portion which is formed with the rolling stock undercarriage, and a lower cover plate, which is held in place by a suitable fastener. Post 66 may extend upwards from a lower cover plate, may extend downwards from the draft box and undercarriage, or a fastener may serve the function of post 66. Regardless of the type of draft box and the structure of post 66, if any, the coupler and centering system of the invention may be "dropped in" to any structure without the requirement for additional centering devices. Springs 48, 50 may be user-adjusted to provided proper centering.

Coupler 20 is shown in a centered position, as indicated by dash-dot line "C" in FIG. 4. Springs 48 and 50 are in what is referred to herein as touching, non-flexed contact with a draft box 52, i.e., springs 48, 50 are operable to maintain coupler 20 in a centered condition without flexing even though they are constructed and arranged so as to be in contact with the interior walls of draft box sides 54, 56, respectively.

Figure 5:
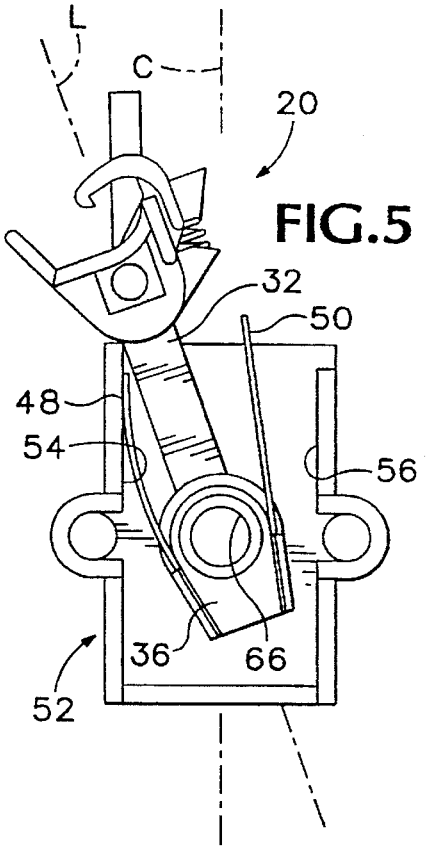
FIGS. 5 and 6 depict the coupler of the invention in off-centered conditions.
Figure 6:
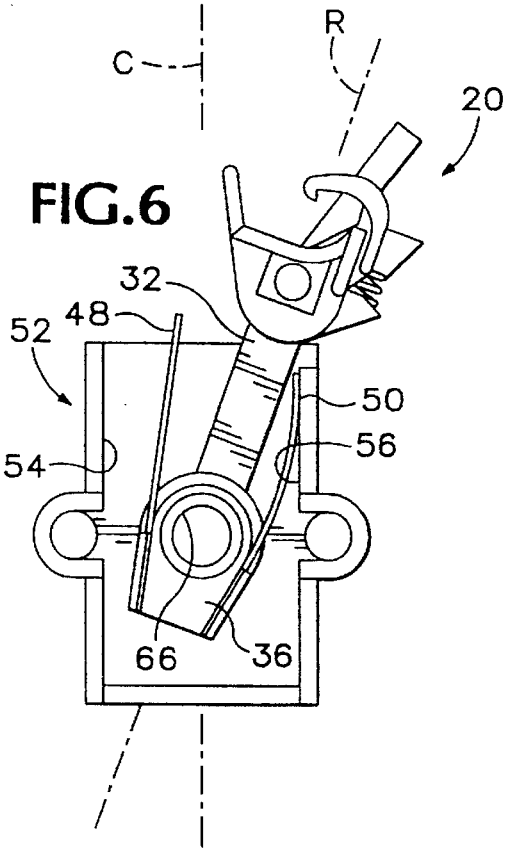

Turning now to FIG. 5, coupler 20 is deflected to the left, with its longitudinal axis extending along dash-double-dot line "L" and with active centering spring 48 being in flexed contact with draft box left sidewall 54, and with inactive centering spring 50 drawn away from right sidewall 56 of the draft box. Active centering spring 48 extends over stepped region 38 when it is flexed. Likewise, in FIG. 6, coupler 20 is deflected to the fight, with its longitudinal axis extending along dash-double-dot line "R", centering spring 50 is active, and is in flexed contact with draft box fight sidewall 56, while centering spring 48 is inactive and is drawn away from left sidewall 54 of the draft box. Put another way, the inactive spring, the one that will not cause the coupler to return to its centered condition, is carried along with the coupler when the coupler is drawn off-center. It should be appreciated that the forces acting on a unit of model railroad rolling stock are not in scale, and that the rolling stock may be derailed if these forces become excessive. For instance, a typical prototypical freight car might weigh 85,000 pounds. An HO scale (1/85) car may be precisely 1/85th the size of a prototypical car, but it will not have 1/85th the mass, i.e., it will not weigh 1000 pounds —it may only weigh a few ounces. Thus, lateral forces are particularly likely to dislodge the rolling stock unit from the track. By carrying the inactive centering spring with the coupler, some of the lateral forces, which might be exerted by the inactive centering spring, are eliminated.

Thus, a centering system for model railroad coupler has been disclosed which will not cause a coupler to be held in an off-centered condition after the coupler has been in an off-centered condition, such as on a section of curved track, for an extended period of time. The coupler is easily manufactured and, because the centering system is a integral part of the coupler, it is easy to install in the draft box, either as found as an integral part of a trait of rolling stock, or as provided as an add-on.

Although a preferred embodiment of the invention has been disclosed herein, it will be appreciated that further modifications and variations may be made thereto without departing from the scope of the invention, as defined in the appended claims.

I claim:

1. A model railroad coupler centering system for use with a couple box, comprising:

a coupler having:

(1) a coupler head and a coupler knuckle carried pivotally thereon;

(2) an elongate coupler shank having one end thereof fixed to said coupler head;

(3) a coupler mounting structure carried at the other end of said coupler shank, wherein said mounting structure includes a mounting plate for pivotally mounting said coupler in the coupler box, said mounting plate further including spaced-apart, forwardly-diverging sides, and (4) plural centering springs fixed to each of said forwardly-diverging sides;

wherein, said centering springs are constructed and arranged to extend, when said coupler is centered, from said mounting plate to the coupler box and to make touching, non-flexed contact therewith; and wherein said centering springs are further constructed and arranged such that, when said coupler is off-center, only one of said centering springs makes contact with the coupler box.

2. The model railroad coupler centering system of claim 1 wherein said mounting structure includes a stepped region extending about a forward portion thereof, and which further includes a centering-spring receiver located along each forwardly-diverging side thereof.

3. A model railroad coupler centering system comprising:

a draft box having spaced apart, longitudinally extending sidewalls and a coupler receiving structure;

a coupler having:

(1) a coupler head and a coupler knuckle carried pivotally thereon;

(2) an elongate coupler shank having one end thereof fixed to said coupler head;

(3) a coupler mounting structure carried at the other end of said coupler shank, wherein said mounting structure includes a mounting plate for pivotally mounting said coupler on said coupler receiving structure, said mounting plate further including a stepped region extending about a forward portion thereof and a centering-spring receiver slot located along each longitudinally extending side thereof, wherein a base of said centering-spring receiver slots is contiguous with said stepped region; and (4) plural centering springs fixed in each of said centering-spring receiver slots;

wherein, said centering springs are constructed and arranged to extend, when said coupler is centered, from said mounting plate to the sides of said draft box and to make touching, non-flexed contact therewith; and wherein said centering springs are further constructed and arranged such that, when said coupler is off-center, one of said centering springs makes flexed contact with a side of said draft box and the other centering spring does not make contact with the other side of said draft box.

4. The model railroad coupler centering system of claim 3 wherein each centering spring is received in its respective centering-spring receiver slot and wherein each of said centering springs is fixed in said centering-spring receiver slot by compression fixing along at least a portion of the length of said centering-spring receiver slot.

5. The model railroad coupler centering system of claim 3 wherein said coupler receiver structure includes a post extending between the bottom of said draft box and a unit of model railroad rolling stock, and said mounting plate includes a bore therethrough, which bore is clearance fittable over said post.

6. The model railroad coupler centering system of claim 3 wherein each of said centering-spring receiver slots is bounded by an exterior side having a slit formed intermediate the ends thereof, and wherein a portion of said exterior side is compressed to retain said centering spring in said centering-spring receiver slot.

7. A model railroad coupler centering system comprising:

a draft box having spaced apart, longitudinally extending sidewalls and a coupler receiving structure;

a coupler having:

(1) a coupler head and a coupler knuckle carried pivotally thereon;

(2) an elongate coupler shank having one end thereof fixed to said coupler head;

(3) a coupler mounting structure carried at the other end of said coupler shank, wherein said mounting structure includes a mounting plate for pivotally mounting said coupler on said coupler receiving structure, said mounting plate further including a stepped region extending about a forward portion thereof, forwardly-diverging longitudinal sides, and a centering-spring receiver slot located along each longitudinal side thereof, wherein a base in each of said centering-spring receiver slots is contiguous with said stepped region; and (4) plural centering springs fixed in each of said centering-spring receiver slots;

wherein, said centering springs are constructed and arranged to extend, when said coupler is centered, from said mounting plate to the sides of said draft box and to make touching, non-flexed contact therewith; and wherein said centering springs are further constructed and arranged such that, when said coupler is off-center, one of said centering springs makes flexed contact with a side of said draft box and the other centering spring does not make contact with the other side of said draft box.

8. The model railroad coupler centering system of claim 7 wherein each centering spring is received in its respective centering-spring receiver slot and wherein each of said centering springs is fixed in said centering-spring receiver slot by compression fixing along at least a portion of the length of said centering-spring receiver slot.

9. The model railroad coupler centering system of claim 7 wherein said coupler receiver structure includes a post extending between the bottom of said draft box and a unit of model railroad rolling stock, and said mounting plate includes a bore therethrough, which bore is clearance fittable over said post.

10. The model railroad coupler centering system of claim 7 wherein each of said centering-spring receiver slots is bounded by an exterior side having a slit formed intermediate the ends thereof, and wherein a portion of said exterior side is compressed to retain said centering spring in said centering-spring receiver slot.

* * * * *